US009536470B2

(12) United States Patent
Numata

(10) Patent No.: US 9,536,470 B2
(45) Date of Patent: Jan. 3, 2017

(54) ORGANIC ELECTROLUMINESCENCE DISPLAY DEVICE

(71) Applicant: Japan Display Inc., Tokyo (JP)

(72) Inventor: Yuichi Numata, Tokyo (JP)

(73) Assignee: Japan Display Inc., Tokyo (JP)

( * ) Notice: Subject to any disclaimer, the term of this patent is extended or adjusted under 35 U.S.C. 154(b) by 41 days.

(21) Appl. No.: 14/093,138

(22) Filed: Nov. 29, 2013

(65) Prior Publication Data

US 2014/0152707 A1 Jun. 5, 2014

(30) Foreign Application Priority Data

Nov. 30, 2012 (JP) ..... 2012-261951

(51) Int. Cl.
*G09G 3/3233* (2016.01)
*G09G 3/32* (2016.01)
*G09G 3/14* (2006.01)

(52) U.S. Cl.
CPC ..... *G09G 3/3233* (2013.01); *G09G 3/14* (2013.01); *G09G 2300/0426* (2013.01); *G09G 2310/0221* (2013.01); *G09G 2320/0233* (2013.01)

(58) Field of Classification Search
CPC ..... G09G 3/3208–3/3291; G09G 3/3266; G09G 2300/0439; G09G 2310/0286
See application file for complete search history.

(56) References Cited

U.S. PATENT DOCUMENTS 5,859,630 A * 1/1999 Huq ..... 345/100
7,786,968 B2 * 8/2010 Yokoyama et al. ..... 345/94
7,999,785 B2 * 8/2011 Ye et al. ..... 345/102
8,629,819 B2 * 1/2014 Umezaki ..... 345/84
2002/0054005 A1 * 5/2002 Edwards et al. ..... 345/87
2002/0084965 A1 * 7/2002 Park ..... 345/87
2002/0113761 A1 * 8/2002 Mizutani et al. ..... 345/87
2003/0001800 A1 1/2003 Nakajima et al.
2005/0068271 A1 * 3/2005 Lo ..... 345/76
2005/0285826 A1 * 12/2005 Park et al. ..... 345/76
(Continued)

FOREIGN PATENT DOCUMENTS

JP 2002-175035 A 6/2002
JP 2002-303846 A 10/2002
JP 2011-203687 A 10/2011

OTHER PUBLICATIONS

Japanese Office Action mailed on Jun. 28, 2016 for corresponding Japanese application No. 2012-261951.

*Primary Examiner* — Patrick F Marinelli
(74) *Attorney, Agent, or Firm* — Typha IP LLC

(57) ABSTRACT

An organic electroluminescence display device is provided in which circuit components can be installed at a high density and which can reduce power consumption. The organic electroluminescence display device of the present invention comprises a display part including a first display area including a plurality of first pixels and a second display area including a plurality of second pixels, and a switch unit formed from a plurality of transistors and switching between display in the first display area and display in the second display area. The switch unit does not drive the plurality of second pixels during a frame time period for driving the plurality of first pixels in the display part and drives the plurality of second pixels during a vertical retrace time period in which the plurality of first pixels are not driven in the display part.

11 Claims, 10 Drawing Sheets

(56) References Cited

U.S. PATENT DOCUMENTS

| | | | | |
|---|---|---|---|---|
| 2005/0285840 | A1* | 12/2005 | Jang et al. | 345/100 |
| 2008/0309653 | A1* | 12/2008 | Takahashi et al. | 345/211 |
| 2009/0121998 | A1* | 5/2009 | Ohkawa et al. | 345/100 |
| 2009/0284500 | A1* | 11/2009 | Yamashita | 345/204 |
| 2012/0081346 | A1* | 4/2012 | Furuta et al. | 345/209 |
| 2012/0127213 | A1* | 5/2012 | Park | 345/690 |
| 2013/0300773 | A1* | 11/2013 | Kim | 345/690 |
| 2014/0085285 | A1* | 3/2014 | Kim | 345/211 |

* cited by examiner (a)

Icon section flashes using LED (b)

*Prior art*

(a)

Icon section flashes by extending organic EL display area (b)

*Prior art*

ORGANIC ELECTROLUMINESCENCE DISPLAY DEVICE

CROSS REFERENCE TO RELATED APPLICATIONS

This application is based upon and claims the benefit of priority from the prior Japanese Patent Application No. 2012-261951, filed on 30 Nov. 2012, the entire contents of which are incorporated herein by reference.

FIELD

The present invention is related to an organic electroluminescence display device.

BACKGROUND

In recent years, the development of organic electroluminescence display devices which use organic electroluminescence materials in light emitting elements (organic electroluminescence devices) of a display part has become particularly active. Unlike liquid crystal display devices and the like, organic electroluminescence display devices realize a display by making organic electroluminescence material emit light and are thus known as self-luminous type display devices which can be used in mobile terminal devices such as smartphones for example.

In addition to the main image display area in mobile terminal devices such as smartphones, various components such as microphones, a camera, light modulation sensors or proximity sensors and the like are being installed with increase in functionality of such devices. While there is demand for an expansion of the main image display area, there is also demand for a decrease in edge periphery regions except the main image display area and high density of components to be installed.

In mobile terminal devices such as smartphones, a configuration is known which flashes an icon section which notifies a user of a received email or which functions as a touch button by using LEDs as shown in FIG. 1 (*a*) for example. In this case, as is shown in FIG. 1(*b*), apart from a data signal for displaying a main image output from a CPU to an OLED control IC, a signal for driving the LEDs of the icon section is output from the CPU to an LED control IC via a serial interface, and since the LED control IC is required to be installed in addition to the OLED control IC, high density is obstructed.

As is shown in FIG. 2 (*a*), there are configurations for expanding display areas using organic electroluminescence devices, not only a main display area but also as far as an icon section in order to achieve high density when installing circuit components in a mobile terminal device such as a smartphone. In this case, as is shown in FIG. 2 (*b*), an icon section signal together with a data signal is output to the OLED control IC via the serial interface. However, the load on a signal line is increased, the driving frequency increases and power consumption is increased due to the need to increase the number of signal lines for transmitting data.

The present invention is arrived at in view of the problems described above and aims to provide an organic electroluminescence display device which can be installed with circuit components at a high density and can reduce power consumption.

SUMMARY

According to one embodiment of the present invention, an organic electroluminescence display device is provided. The organic electroluminescence display device comprises a display part including a first display area including a plurality of first pixels, and a second display area including a plurality of second pixels, a switch unit formed from a plurality of transistors, the switch unit switching between a display in the first display area and a display in the second display area, a gate drive circuit outputting a gate signal for driving the plurality of first pixels and a switch signal for switching the switch unit ON and OFF, a plurality of gate lines connecting the gate drive circuit and the plurality of first pixels and transmitting the gate signals, a switch control signal line connecting the gate drive circuit and the switch unit and transmitting the switching signal to the switch unit, a source drive circuit providing a drive voltage corresponding to a luminance of the plurality of first pixels and a predetermined voltage for driving the plurality of second pixels, and a plurality of data lines connecting the source drive circuit with the plurality of first pixels and the plurality of second pixels, and transmitting the drive voltage to the plurality of first pixels and the predetermined voltage to the plurality of second pixels, wherein the switch unit does not drive the plurality of second pixels during a frame time period for driving the plurality of first pixels in the display part and drives the plurality of second pixels during a vertical retrace time period in which the plurality of first pixels are not driven in the display part.

Each of the plurality of first pixels and the plurality of second pixels may include an organic electroluminescence device.

A predetermined data line among the plurality of data lines may be commonly connected with the plurality of first pixels and the plurality of second pixels via the switch unit.

The switch unit may be arranged between the first display area and the second display area, each gate of the plurality of transistors of the switch unit may be commonly connected to the switch control signal line, each drain of the plurality of transistors of the switch unit may be connected to a data line connected to a first pixel arranged at a position corresponding to the second display area in the first display area, and each source of the plurality of transistors of the switch unit may be connected to a data line connected to a corresponding second pixel in the second display area.

The organic electroluminescence display device may comprise a CPU being externally supplied with image data and a plurality of control signals for outputting the image data and processing the supplied image data and the plurality of control signals, a timing signal generation circuit receiving the image data and the plurality of control signals supplied from the CPU and generating an image data signal, a vertical synchronizing signal, a gate clock signal and a gate start signal in response to the image data and the plurality of control signals, and a drive voltage generation circuit generating a reference signal according to a display gradation. The gate drive circuit may output the gate signal in response to the gate clock signal and the gate start signal. The source drive circuit may select a reference voltage supplied from the drive voltage generation circuit based on the image data signal supplied from the timing signal generation circuit, and output the selected reference voltage in response to the gate signal to the plurality of data lines as a drive voltage. In addition, the CPU may generate a control signal for driving the plurality of second pixels. Also, the organic electroluminescence display device may comprise a lamp control circuit outputting an output control signal for outputting the predetermined voltage for driving the plurality of second pixels to the source drive circuit according to a level of a control signal for driving the plurality of second pixels supplied from the CPU. The timing signal generation circuit, the drive voltage generation circuit and the lamp control circuit may be installed on a driver IC.

The gate drive circuit may include a shift register unit including a plurality of shift registers, and a set/reset circuit. The shift register unit may output the gate signal in sequence in the frame time period in response to the gate start signal. The set/reset circuit may output the switch signal in the vertical retrace time period.

According to the present invention it is possible to provide an organic electroluminescence display device which can be installed with circuit components at a high density and can reduce power consumption.

BRIEF DESCRIPTION OF THE DRAWINGS

FIG. 1 (*b*) is a diagram for explaining a driving method of the mobile terminal device shown in FIG. 1 (*a*);

FIG. 2 (*b*) is a diagram for explaining a driving method of the mobile terminal device shown in FIG. 2 (*a*);

DESCRIPTION OF THE EMBODIMENTS

The organic electroluminescence display devices related to the embodiments of the present invention are explained in detail below while referring to drawings. The embodiments shown below are examples of the present invention and the present invention is not limited by these embodiments. Furthermore, although the organic electroluminescence display device is explained using a smartphone as an example in the embodiments herein, the organic electroluminescence display device of the present invention is not limited to a smartphone.

Figure 1:
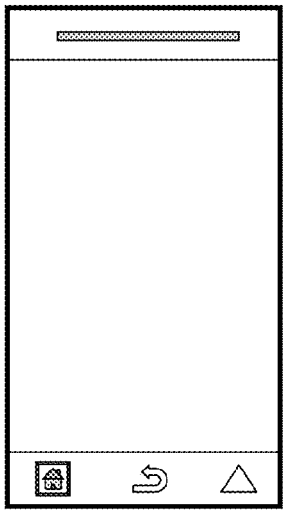
FIG. 1 (*a*) is a schematic diagram showing a conventional mobile terminal device.
Figure 1:
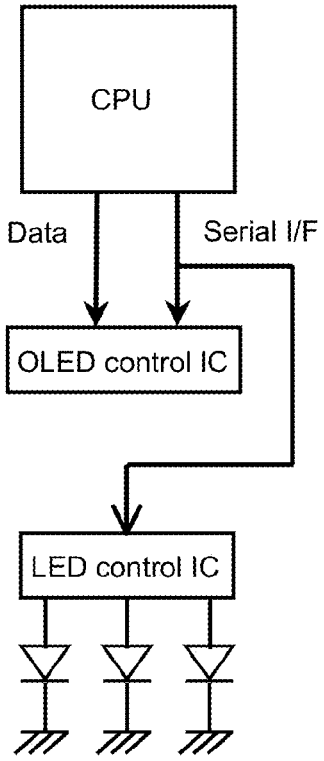
Figure 2:
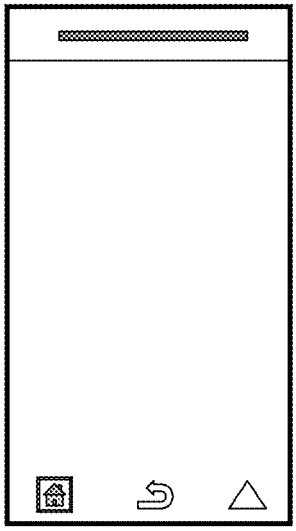
FIG. 2 (*a*) is a schematic diagram showing a conventional mobile terminal device.
Figure 2:
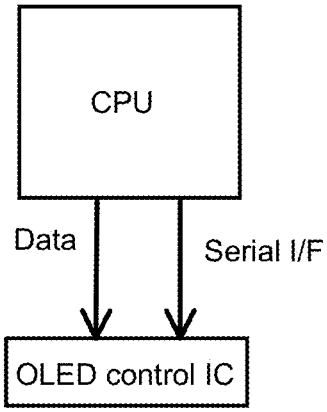
Figure 3:
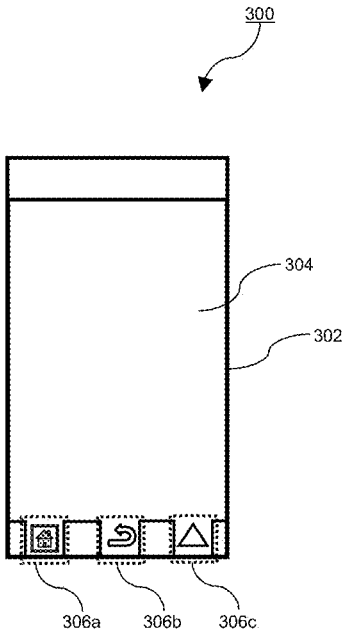
FIG. 3 is a schematic diagram of an organic electroluminescence display device related to one embodiment of the present invention.

FIG. 3 is a schematic diagram of an organic electroluminescence display device 300 related to one embodiment of the present invention. The organic electroluminescence display device 300 includes a display part 302, the display part 302 includes a first display area 304 which displays a main image and second display areas 306*a*, 306*b*, 306*c* which notify a user of a received mail or call and display icons which function as touch buttons. Here, although three second display areas 306*a*, 306*b*, 306*c* are shown, the number of second display areas is not limited to three.

Figure 4:
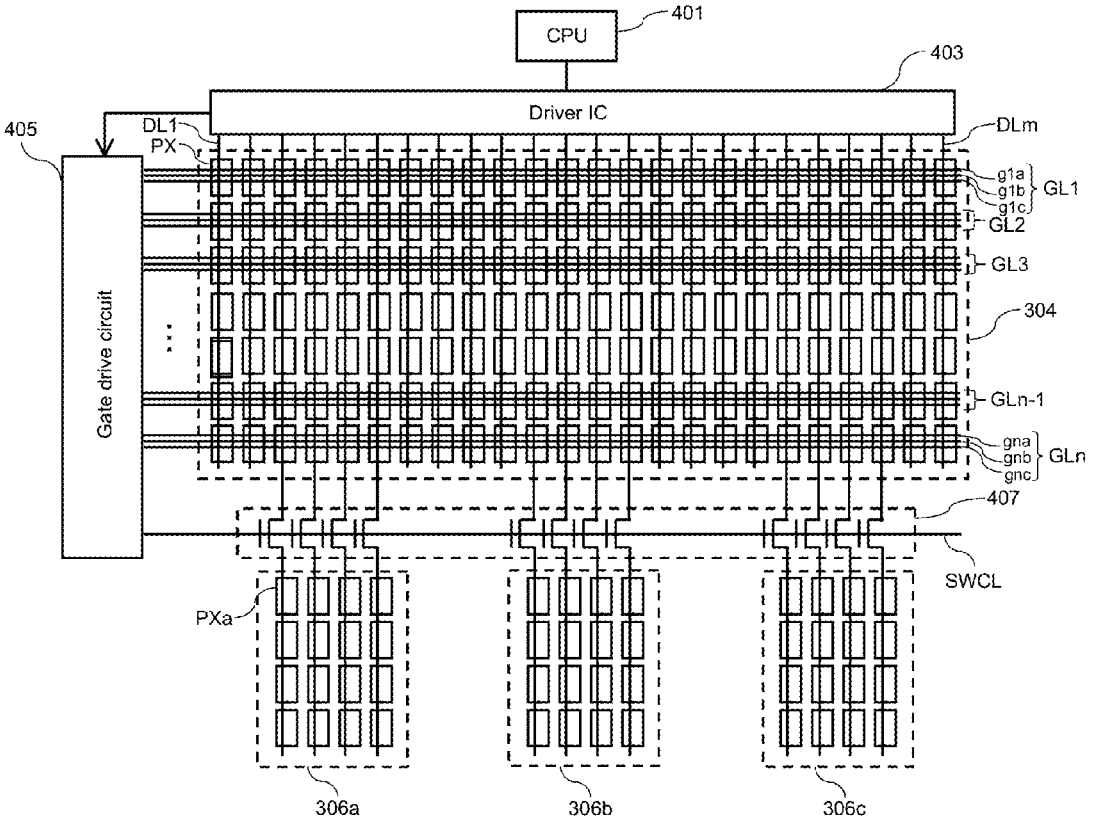
FIG. 4 is a schematic diagram showing the internal structure of the organic electroluminescence display device shown in FIG. 3.

FIG. 4 is a schematic diagram of the internal structure of the organic electroluminescence display device 300 of the present invention. The organic electroluminescence display device 300 includes a CPU 401, a driver IC 403, a gate drive circuit 405, gate lines GL1~GLn, data lines DL1~DLm, a switch control signal line SWCL, a power supply unit (not shown in the diagram), a power supply line VDD (not shown in the diagram) connected to the power supply unit, and a switching unit 407. A plurality of first pixels PX for image display are arranged in a matrix at a position at which the gate lines GL1~GLn and the data lines DL1~DLm intersect in the first display area, and a plurality of second pixels PXa for icon display are arranged in each second display area 306*a*~306*c*. The switching unit 407 is arranged between the first display area 304 and the second display areas 306*a*~306*c*. Among the data lines DL1~DLm, data lines connected to first pixels PX arranged at positions corresponding to the second display areas 306*a*~306*c* in the first display area 304 are commonly connected to corresponding second pixels PXa in the second display areas 306*a*~306*c* via the switching unit 407 respectively. The switching unit 407 includes a plurality of switching transistors and each gate of the plurality of transistors is commonly connected to the switching control signal line SWL. Each drain of the plurality of switching transistors is connected to a data line connected to a first pixel arranged at a position corresponding to the second display areas 306*a*~306*c* in the first display area 304, and each source of the plurality of switching transistors is connected to the data line connected to a corresponding second pixel PXa in the second display areas 306*a*~306*c*. As shown in FIG. 4, the gate lines GL1~GLn may each include the three gate signal lines, for example, the gate line GL1 may include the gate signal lines g1*a*~g1*c* and the gate line GLn may include the gate signal lines gna~gnc. The number of gate signal lines includes in a gate line is not limited and may be appropriately modified according to the structure of the first pixel PX. The first pixel PX includes drive transistors and capacitors for controlling the luminance of each pixel PX according to the driving voltage Data supplied from the data lines DL1~DLm. Although not shown in the diagram, the organic electroluminescence display device 300 may also include a touch sensor according to necessity.

Figure 5:
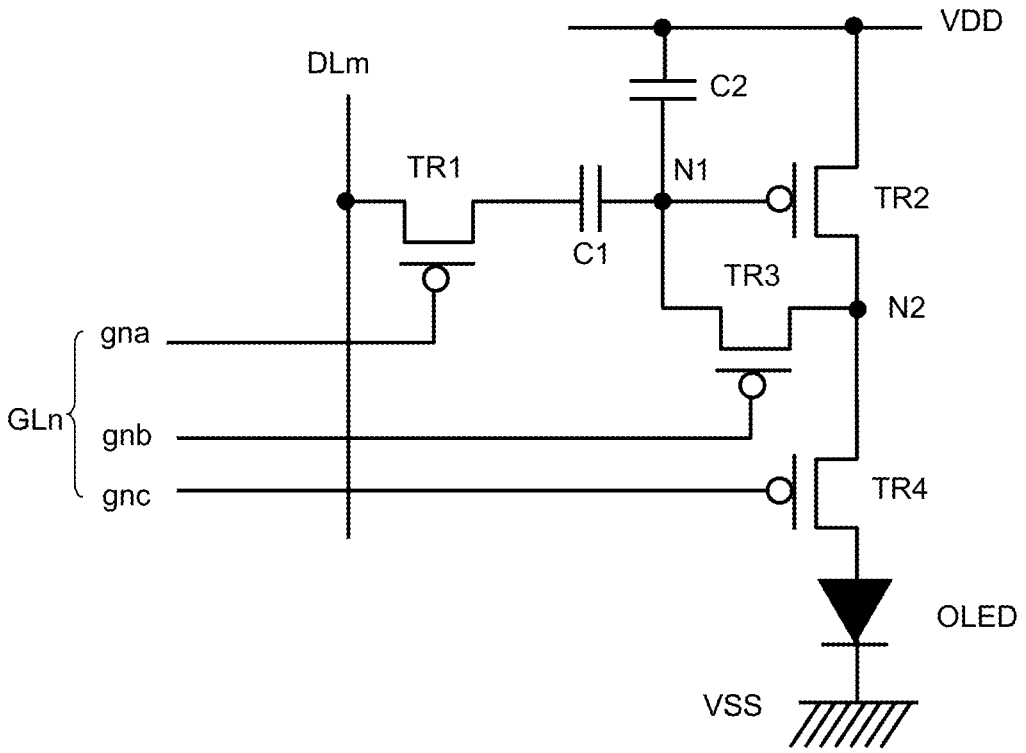
FIG. 5 is an equivalent circuit diagram showing an example of the structure of a pixel PX arranged in a first display area of the organic electroluminescence display device shown in FIG. 3.

FIG. 5 shows an example of the structure of the first pixel PX arranged at a position at which a gate line GLn and data line DLm intersect in the first display area 304. The first pixel PX includes four drive transistors TR1~TR4, two capacitors C1, C2 and an organic electroluminescence device OLED. The source of the drive transistor TR1 is connected to the data line DLm, the drain of the drive transistor TR1 is connected to the capacitor C1 and the gate of the drive transistor TR1 is connected to a gate signal line gna. The capacitor C1 is arranged between the drain of the drive transistor TR1 and a first node N1. The capacitor C2 is arranged between a power supply line VDD and the first node N1. The source of the drive transistor TR2 is connected to the power supply line VDD, the drain of the drive transistor TR2 is connected to a second node N2 and the gate is connected to the first node N1. The source of the drive transistor TR3 is connected to the first node N1, the drain of the drive transistor TR3 is connected to the second node N2 and the gate is connected to a gate signal line gnb. The source of the drive transistor TR4 is connected to the second node N2, the drain of the drive transistor TR4 is connected to the anode side of the organic electroluminescence device OLED and the gate of the drive transistor TR4 is connected to a gate signal line gnc. The anode of the organic electroluminescence device OLED is connected to the drain of the drive transistor TR4 and the cathode of the organic electroluminescence device OLED is connected to ground. Furthermore, the structure of the first pixel PX shown in FIG. 5 is an example and not limited to this structure.

Figure 6:
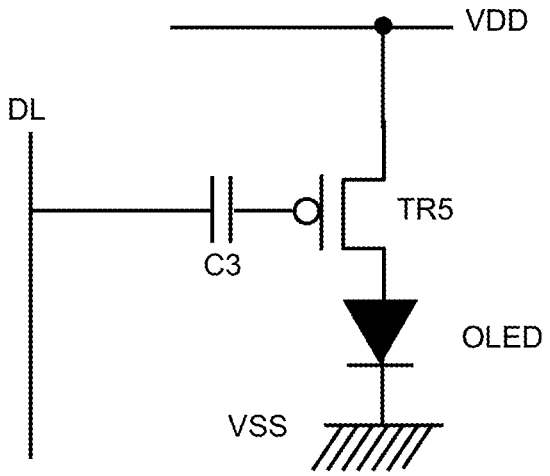
FIG. 6 is an equivalent circuit diagram showing an example of the structure of a pixel PXa arranged in a second display area of the organic electroluminescence display device shown in FIG. 3.

FIG. 6 shows an example of the structure of a second pixel PXa arranged in the second display areas 306*a*, 306*b*, 306*c*. The second pixel PXa includes a drive transistor TR5, a capacitor C3 and an organic electroluminescence device OLED. The capacitor C3 is arranged between a data line DL and the gate of the drive transistor TR5. The source of the drive transistor TR5 is connected to a power supply line VDD, the drain of the drive transistor TR5 is connected to the anode side of the organic electroluminescence device OLED and the gate of the drive transistor TR5 is connected to the condenser C3. The anode of the organic electroluminescence device OLED is connected to the drain of the drive transistor TR5 and the cathode of the organic electroluminescence device OLED is connected to ground. Furthermore, the structure of the second pixel PXa shown in FIG. 6 is an example and not limited to this structure.

Figure 7:
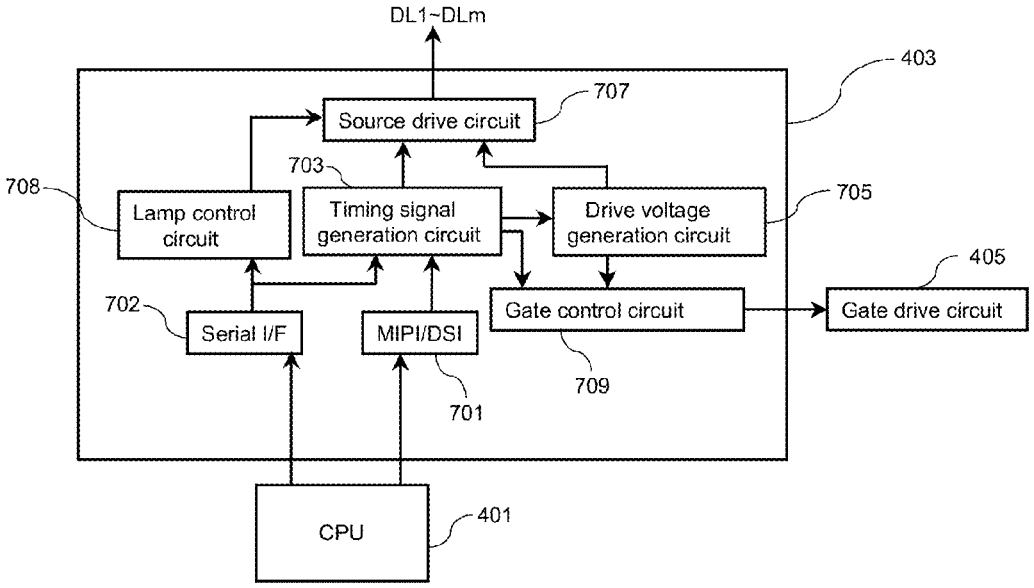
FIG. 7 is a block diagram showing an example of the structure of a driver IC in the organic electroluminescence display device shown in FIG. 3.

FIG. 7 is a block diagram which shows an example of the structure of a driver IC 403 of the organic electroluminescence display device 300. The driver IC 403 includes a mobile industry processor interface/display serial interface (MIPI/DSI) 701, a serial interface 702, a timing generation circuit 703, a drive voltage generation circuit 705, a source drive circuit 707, a lamp control circuit 708 and a gate control circuit 709.

Referring to FIG. 7, image data and a plurality of control signals for outputting image data are externally input to CPU 401, and various processes such as synthesis, expansion, reduction and data conversion of the image data are performed in CPU 401. The image data converted for display is output to the timing signal generation circuit 703 via the MIPI/DSI 701 of the driver IC 403. In addition, register data required for power supply control and display control is output to the timing signal generation circuit 703 from the CPU 401 via the serial interface 702. The timing signal generation circuit 703 receives the register data and outputs a signal for controlling a drive voltage in response to the register data to the drive voltage generation circuit 705. Also, the timing signal generation circuit 703 receives image data, generates image data signal R, G, B based on the Image data and output the image data signal R, G, B to the source drive circuit 707. In addition, the timing signal generation circuit 703 receives a plurality of control signals for outputting image data and generates a control signal such as a vertical synchronizing signal Vsync, gate clock signal and gate start signal in response to the plurality of control signals. The vertical synchronizing signal Vsync, gate clock signal and gate start signal are output to the gate drive circuit 405 from the timing signal generation circuit 703 via the gate control circuit 709. The drive voltage generation circuit 705 generates a power supply voltage required for gate driving or source driving and outputs the power supply voltage to the source drive circuit 707 and gate control circuit 709. Also, the drive voltage generation circuit 705 generates a reference voltage corresponding to a display gradation and outputs the reference voltage to the source drive circuit 707. The source drive circuit 707 selects a reference voltage corresponding to the image data signals R, G, B, and outputs the selected reference voltage to each data line DL1~DLm as a drive voltage Data in response to a gate signal described below. In addition, although not shown in the diagram, the timing signal generation circuit 703 outputs a timing signal for controlling the output of a power supply voltage to a power supply part.

In the case where email is received or in the case where one of the second display areas 306*a*~306*c* as touch buttons is touched by a user, a binary signal of high level or low level which signifies whether email has been received or the presence of a user's touch is output from the CPU 401 via the serial interface 702 and provided to the lamp control circuit 708. The lamp control circuit 708 includes a register. The lamp control circuit 708 outputs a control signal for outputting a certain voltage for driving second pixels PXa of the second display areas 306*a*~306*c* to the source drive circuit 707 in response to the level of the binary signal received via the serial interface 702. The source drive circuit 707 outputs the certain voltage to data lines connected to the second pixels PXa of the second display area 306*a*~306*c* among the data lines DL1~DLm.

Here, a structure in which the mobile industry processor interface/display serial interface (MIPI/DSI) 701, the serial interface 702, the timing generation circuit 703, the drive voltage generation circuit 705, the source drive circuit 707, the lamp control circuit 708 and the gate control circuit 709 are installed in the driver IC 403 is explained. However, the organic electroluminescence display device 300 of the present invention is not limited to this structure and each interface or circuit may be separately installed.

Figure 8:
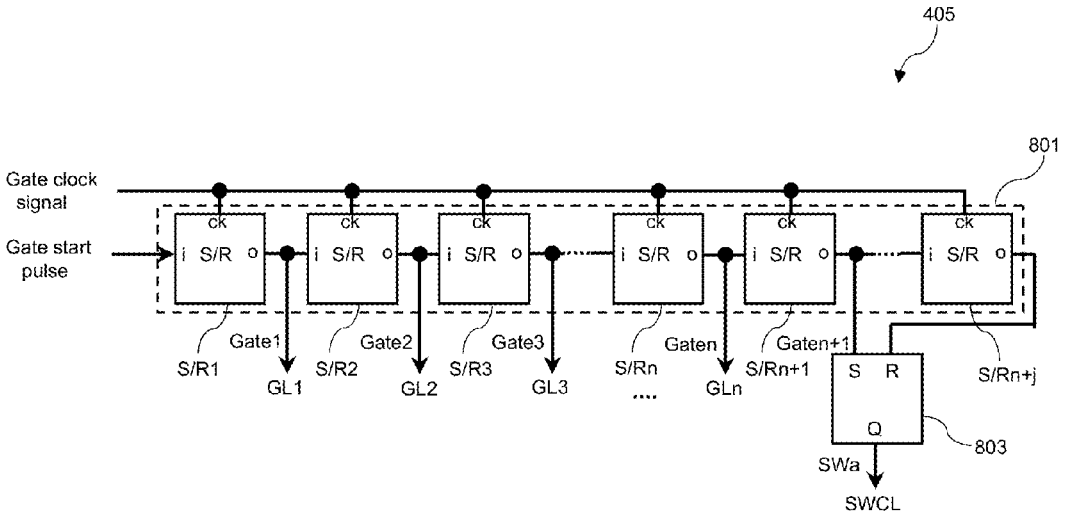
FIG. 8 is a block diagram showing an example of the structure of a gate driving unit in the organic electroluminescence display device shown in FIG. 3.

FIG. 8 is schematic diagram which shows an example of the structure of the gate drive circuit 405 of the organic electroluminescence display device 300. The gate drive circuit 405 includes a shift register part 801 and a set/reset circuit 803. The shift register part 801 includes a plurality of shift registers S/R1~S/Rn+j (here, j is an integer of 2 or more). A gate clock signal is input to a clock terminal ck of each shift register S/R1~S/Rn+j. A gate start pulse is input to an input terminal i of the first stage shift register S/R1. The shift register S/R1 outputs a gate signal Gate1 from an output terminal o to the gate line GL1 in synchronization with the gate clock signal. The gate signal Gate1 output from the output terminal o of the shift register S/R1 is input to an input terminal i of the second stage shift register S/R2. When the shift register S/R2 receives an input of the gate signal Gate1, the shift register S/R2 outputs a gate signal Gate2 from an output terminal o to the gate line GL2 in synchronization with the gate clock signal. Similarly, in the third stage shift register S/R3 to the n-th stage shift register S/Rn, each input terminal i of the third stage shift register S/R3 to the n-th stage shift register S/Rn respectively receives an input of the gate signal Gate2~Gaten−1 output from the previous stage. The third stage shift register S/R3 to the n-th stage shift register S/Rn output gate signal Gate3~Gaten from their output terminal o to the gate lines GL3~GLn respectively in synchronization with the gate clock signal.

The output Gaten of the n stage shift register S/Rn is input to an input terminal of the n+1-th stage shift register S/Rn+1. The shift register S/Rn+1 receives an input of Gaten and outputs a signal Gaten+1 from an output terminal o of the shift register S/Rn+1 in synchronization with the gate clock signal. The output Gaten+1 from the shift register S/Rn+1 is input to an input terminal i of a subsequent stage shift register to the shift register S/Rn+1 and to a set terminal S of the set/reset circuit 803. The set/reset circuit 803 outputs a switch signal SWa for the second display area to the switch control signal line SWCL in synchronization with the gate clock signal. The set/reset circuit 803 receives an input of Gaten+1 to the set terminal S and outputs a high level switch signal SWa from an output terminal Q in response to the input of Gaten+1. The switch signal SWa is maintained at a high level until the signal Gaten+j output from an output terminal o of the last stage shift register S/Rn+j is input to a reset terminal R of the set/reset circuit 803. When the signal Gaten+j output from the shift register S/Rn+j is input to the reset terminal R of the set/reset circuit 803, the switch signal SWa output from the output terminal Q is returned to a low level.

Here, a predetermined number of shift registers may be arranged between the n+1-th stage shift register S/Rn+1 and the last stage shift register S/Rn+j. In the shift registers S/Rn+1~S/Rn+j, a signal output from the former stage shift register output terminal o is input to the input terminal of the subsequent stage shift register. However, as described above, the output signal Gaten+1 output from the n+1-th stage shift register S/Rn+1 is also input to the set terminal S of the set/reset circuit 703, and the output signal Gaten+j of the last stage shift register S/Rn+j is input to the reset terminal R of the set/reset circuit 803. By appropriately adjusting the number of shift registers arranged between the n+1-th stage shift register S/Rn+1 and the last stage shift register S/Rn+j, it is possible to adjust the high level period of the switch signal SWa output from the set/reset circuit 703.

Figure 9:
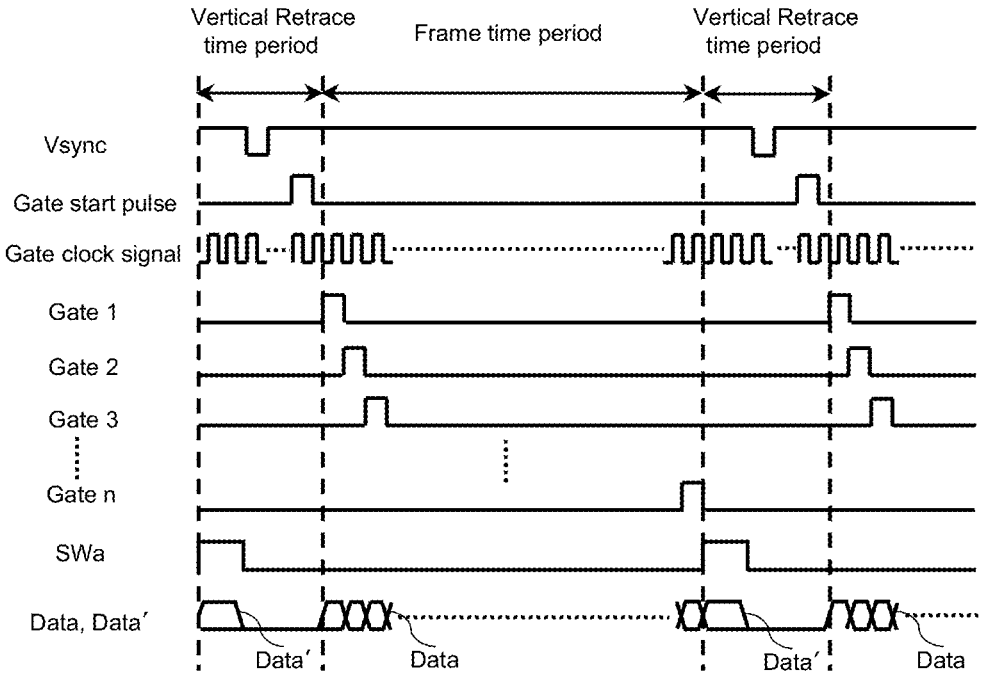
FIG. 9 is a timing diagram of each signal output from a gate driving unit and a source driving circuit in the organic electroluminescence display device shown in FIG. 3.

FIG. 9 is a diagram which shows the timing of each signal output from the gate drive circuit 405 and the source drive circuit 707. Referring to FIG. 9, in one frame time period, gate signals Gate1~Gaten are sequentially output from the gate drive circuit 405 to the gate lines GL1~GLn in synchronization with the gate clock signal. The drive transistors TR1~TR4 of the first pixel PX arranged in the first display region 304 are driven in sequence for each row in response the gate signals Gate1~Gaten, and drive voltage Data corresponding to each luminance of the first pixel PX is applied to corresponding pixel PX for each row from the source drive circuit 707 via the data lines DL1~DLn. A current depending on the drive voltage Data respectively applied to each first pixel PX flows to the organic electroluminescence device OLED of a first pixel PX and the organic electroluminescence device OLED emits light at a luminance according to the amount of flowing current. In this way, in a frame period, a main image is displayed in the first display area 304 of the organic electroluminescence display device 300. During the frame time period, a switch signal SWa for icon display output from the gate drive circuit 405 is a low level and all a plurality of switching transistors of the switch unit 407 are all in an OFF state. As a result, a predetermined voltage Data' is not output from the source drive circuit 707 and the second pixels PXa of the second display areas 306*a*, 306*b*, 306*c* of the organic electroluminescence display device 300 are not driven.

On the other hand, in a vertical retrace time period, a high level switch signal SWa is output from the gate drive circuit 405 to the switch control signal line SWCL in synchronization with the gate clock signal. The plurality of switching transistors of the switch unit 407 is turned ON in response to the switch signal SWa. The source drive circuit 407 applies a predetermined voltage Data' to the second pixels PXa of the second display areas 306*a*, 306*b*, 306*c* via data lines connected to the second pixels PXa of the second display areas 306*a*, 306*b*, 306*c* among the data lines DL1~DLm. A current depending on the predetermined voltage Data' respectively applied to each second pixel PXa flows to the organic electroluminescence device OLED in the second pixel PXa and the organic electroluminescence device OLED in the second pixel PXa emits light at a luminance according to the amount of flowing current. Since gate signals Gate1~Gaten are not output from the gate drive circuit 405 during the vertical retrace time period, a drive voltage Data is not output from the source drive circuit 707 and the first pixels PX in the first display area 304 of the organic electroluminescence display device 300 are not driven.

Furthermore, in FIG. 9, although the switch signal SWa is shown as becoming a high level during a part of the vertical retrace time period, the signal is not limited to this. The switch signal SWa may be a high level during all of the vertical retrace time period. As described above, the high level time period of a switch signal SWa in a vertical retrace time period is determined according to the number of shift registers arranged between the n+1-th stage shift register S/R+1 and the last stage shift register SRn+j in the shift register part 801.

As described when referring to FIG. 4, among the data lines DL1~DLm, data lines connected to first pixels PX arranged at positions corresponding to second display areas 306*a*~306*c* in the first display area 304 are commonly connected to corresponding second pixels PXa in the second display areas 306*a*~306*c* via the switch unit 407 respectively. In the organic electroluminescence display device 300 of the present invention, driving the first pixels PX in the first display area 304 and driving the second pixels PXa in the second display areas 306*a*, 306*b*, 306*c* are switched by the switch unit 407. That is, as described when referring to the FIG. 9 above, although the first pixels PX in the first display area 304 are driven in the frame time period and a main image is displayed, while the second pixels PXa in the second display areas 306*a*, 306*b*, 306*c* are not driven since the switch unit is in an OFF state. On the other hand, since the switch unit 407 is in an ON state during the vertical retrace time period, the second pixels PXa of the second display areas 306*a*, 306*b*, 306*c* are driven and an icon or icons are displayed in the second display areas 306*a*, 306*b*, 306*c*, while the first pixel PX of the first display area is not driven.

Therefore, in the organic electroluminescence display device 300 of the present invention, predetermined first pixels PX in the first display area 304 and second pixels PXa in the second display areas 306*a*-306*c* share predetermined data lines via the switch unit 407. That is, drive voltage Data for driving first pixels PX in the first display area 304 and predetermined voltage Data' for driving second pixels PXa in the second display areas 306*a*, 306*b*, 306*c* are transmitted to the first pixels PX and second pixels PXa using a common data line and thereby, it is not necessary to arrange a separate signal lines for transmitting the predetermined voltage Data' to the second pixels PXa in the second display areas 306*a*, 306*b*, 306*c* other than the data lines DL1~DLm. Since it is not necessary to increase the number of signal lines, the load on signal lines is not increase and it is not necessary to raise a driving frequency.

Furthermore, since driving the first pixels PX in the first display area 304 and driving the second pixels PXa in the second display areas 306*a*, 306*b*, 306*c* are switched by the switch unit 407, the second pixels in the second display areas 306*a*, 306*b*, 306*c* are not driven in a frame time period, and the first pixels PX in the first display area 304 are not driven in a vertical retrace time period. Consequently, it is possible to reduce power consumption of the organic electroluminescence display device 300.

In addition, in the organic electroluminescence display device 300 of the present invention, the display areas using organic electroluminescence devices are expanded to not only the first display area 304 which displays a main image, but also to the second display areas 306*a*~306*c* for notifying a user of a received mail or phone call or displaying an icon which functions as a touch button. As a result, it is not necessary to separately arrange drive ICs or drive circuits for driving the first pixels PX in the first display area 304 and for driving second pixels PXa in the second display areas 306*a*~306*c*, and it is possible to install circuit components at a high density.

Figure 10:
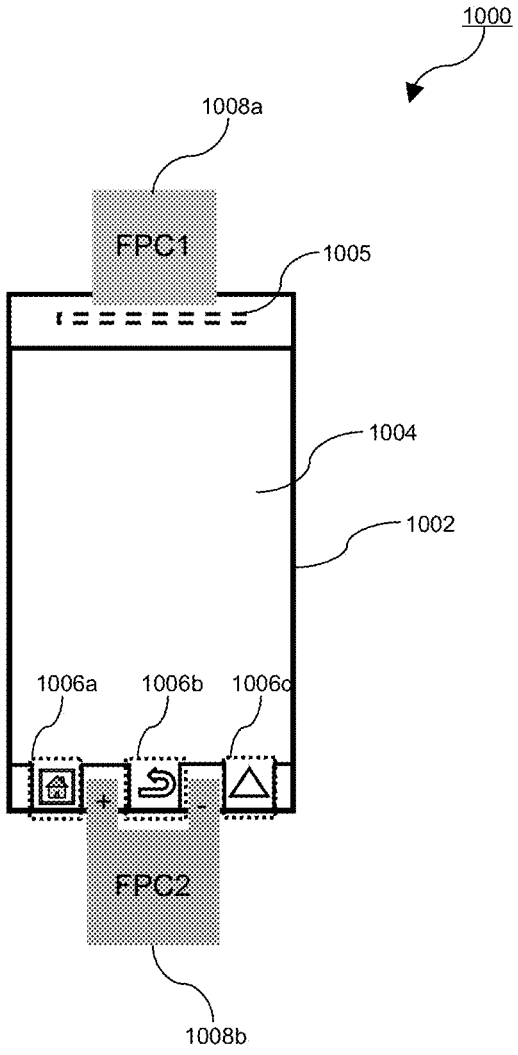
FIG. 10 is a schematic of an organic electroluminescence display device related to another embodiment of the present invention.

FIG. 10 is a schematic diagram of an organic electroluminescence display device 1000 related to another embodiment of the present invention. The organic electroluminescence display device 1000 includes a display part 1002 and an internal drive IC1005. The display part 1002 includes a first display area 1004 which displays a main image and second display areas 1006*a*, 1006*b*, 1006*c* which notify a user of a received mail or call and display icons which function as touch buttons. Here, although three second display areas 1006*a*, 1006*b*, 1006*c* are shown, the number of second display areas is not limited to three. Since the basic structure of the organic electroluminescence display device 1000 is the same as the organic electroluminescence display device 300 described above, here an overlapping explanation is omitted.

Unlike the organic electroluminescence display device 300, the organic electroluminescence display device 1000 includes two power supply units 1008*a*, 1008*b*. The first power supply unit 1008*a* is mounted on a first flexible print circuit substrate FPC1, and is arranged on an upper part side of the organic electroluminescence display device 1000. The first power supply unit 1008*a* supplies power to first pixels PX on the upper side of the display part 1002 including the upper part side of the first display area 1004 of the organic electroluminescence display area 1000. The second power supply unit 1008*b* is mounted on a second flexible print circuit substrate FPC2, and is arranged on a lower part side of the organic electroluminescence display device 1000. The fsecond power supply unit 1008*b* supplies power to first pixels PX on the lower side of the first display ara 1004 and pixels on the lower side of the display part 1002 including the second pixels PXa in the second display areas 1006*a*, 1006*b*, 1006*c*.

Similar to the organic electroluminescence display device 300 in the organic electroluminescence display device 1000, data lines connected to first pixels arranged at corresponding positions in the second display areas 1006*a*~1006*c* in the first display area 1004 are commonly connected to corresponding second pixels PXa in the second display areas 1006*a*~1006*c* respectively via a switch unit 1007 (not shown in the diagram). Also, drive voltage Data for driving the first pixels PX and predetermined voltage Data' for driving second pixels PXa are each transmitted to the first pixels PX and second pixels PXa via a common data line. As a result, in the organic electroluminescence display device 1000, apart from a data line, it is not necessary to separately arrange signal lines for transmitting predetermined voltage Data' to the second pixels PXa and to increase the number of signal lines. Therefore, it is possible to arranged a space between each second display area 1006*a*, 1006*b*, 1006*c* and arranged a connection part of the second power supply unit 1008*b* using this space.

By supplying power to the first pixels PX and/or second pixels PXa in the display part 1002 from both power supply units 1008*a*, 1008*b* arranged on the upper side part and lower side part of the organic electroluminescence display device 1000, it is possible to shorten a power supply line VDD (not shown in the diagram) which connects the first power supply unit 1008*a* or second power supply unit 1008*b* and the first pixels PX and/or second pixels PXa in the display part 1002 and reduce the resistance of the power supply line VDD. By reducing the resistance of the power supply line VDD and supplying power to the first pixels PX and/or second pixels PXa in the display part 1002 from both the upper side part and lower side part of the organic electroluminescence display device 1000, a luminance difference in the display part 1002 of the organic electroluminescence display device 1000 is reduced.

What is claimed is:

1. An organic electroluminescence display device comprising:

a display part including a first display area including a plurality of first pixels, and second display areas, each of the second display areas including a plurality of second pixels;

a switch unit formed from a plurality of transistors and switching between a display in the first display area and a display in the second display areas;

a gate drive circuit outputting a gate drive signal for driving the plurality of first pixels and a switch signal for switching the switch unit ON and OFF;

n gate lines connecting the gate drive circuit and the plurality of first pixels and transmitting the gate signals, wherein n is an integer of 1 or more;

a switch control signal line connecting the gate drive circuit and the switch unit and transmitting the switching signal to the switch unit;

a source drive circuit providing a drive voltage corresponding to a luminance of the plurality of first pixels and a predetermined voltage for driving the plurality of second pixels; and a plurality of data lines connecting the source drive circuit with the plurality of first pixels and the plurality of second pixels and transmitting the drive voltage to the plurality of first pixels and the predetermined voltage to the plurality of second pixels, wherein the plurality of first pixels are arranged at a position at which the gate lines and the data lines intersect in the first display area, the plurality of second pixels are arranged at positions corresponding to the second display areas, the gate drive circuit includes a shift register including n+j shift registers and a set/reset circuit, wherein j is an integer of 3 or more, a set terminal of the set/reset circuit is directly connected to an output terminal of n+1-th shift register, a reset terminal of the set/reset circuit is directly connected of an output terminal of n+j-th shift register, an output terminal of the set/reset circuit is connected to the switch control signal line, the shift register unit outputs the gate signal in sequence in the frame time period in response to a gate start signal, and the set/reset circuit output the switch signal to the switch control signal line in a vertical retrace time period, and the switch unit does not drive the plurality of second pixels during a frame time period for driving the plurality of first pixels in the display part and drives the plurality of second pixels during the vertical retrace time period in which the plurality of first pixels are not driven in the display part, the n+j-th shift register is the last shift register of the n+j shift registers and only supplies an output signal to the reset terminal of the set/reset circuit, and the n+1-th shift register has an input terminal that is directly connected to the output terminal of the n-th shift register and the n-th gate line.

2. The organic electroluminescence display device according to claim 1, wherein each of the plurality of first pixels and the plurality of second pixels include an organic electroluminescence device.

3. The organic electroluminescence display device according to claim 1, wherein a predetermined data line among the plurality of data lines is commonly connected with the plurality of first pixels and the plurality of second pixels via the switch unit.

4. The organic electroluminescence display device according to claim 2, wherein a predetermined data line among the plurality of data lines is commonly connected with the plurality of first pixels and the plurality of second pixels via the switch unit.

5. The organic electroluminescence display device according to claim 3, wherein the switch unit is arranged between the first display area and the second display areas each gate of the plurality of transistors of the switch unit is commonly connected to the switch control signal line, each drain of the plurality of transistors of the switch unit is connected to a data line connected to a first pixel arranged at a position corresponding to each of the second display areas in the first display area, and each source of the plurality of transistors of the switch unit is connected to a data line connected to a corresponding second pixel in each of the second display areas.

6. The organic electroluminescence display device according to claim 4, wherein the switch unit is arranged between the first display area and the second display areas, each gate of the plurality of transistors of the switch unit is commonly connected to the switch control signal line, each drain of the plurality of transistors of the switch unit is connected to a data line connected to a first pixel arranged at a position corresponding to each of the second display areas in the first display area, and each source of the plurality of transistors of the switch unit is connected to a data line connected to a corresponding second pixel in the second display areas.

7. The organic electroluminescence display device according to claim 1 further comprising:

a CPU externally supplied with image data and a plurality of control signals for outputting the image data and processing the supplied image data and the plurality of control signals;

a timing signal generation circuit receiving the image data and the plurality of control signals supplied from the CPU and generating an image data signal, a vertical synchronizing signal, a gate clock signal and a gate start signal in response to the image data and the plurality of control signals; and a drive voltage generation circuit generating a reference signal according to a display gradation;

wherein the gate drive circuit outputs the gate signal in response to the gate clock signal and the gate start signal;

the source drive circuit selects a reference voltage supplied from the drive voltage generation circuit based on the image data signal supplied from the timing signal generation circuit, and outputs the selected reference voltage in response to the gate signal to the plurality of data lines as a drive voltage.

8. The organic electroluminescence display device according to claim 7, wherein the CPU generates a control signal for driving the plurality of second pixels, and further comprising:

a lamp control circuit outputting an output control signal for outputting the predetermined voltage for driving the plurality of second pixels to the source drive circuit according to a level of a control signal for driving the plurality of second pixels supplied from the CPU.

9. The organic electroluminescence display device according to claim 8, wherein the timing signal generation circuit, the drive voltage generation circuit and the lamp control circuit are installed on a driver IC.

10. The organic electroluminescence display device according to claim 2, wherein;

each of the n gate lines includes a first gate line, a second gate line and a third gate line, each of the plurality of first pixels has a first transistor, a second transistor, a third transistor, a fourth transistor, a first capacitor and a second capacitor, a source of the first transistor is connected to a corresponding data line and a gate of the first transistor is connected to a first gate line of a corresponding gate line, an end terminal of the first capacitor is connected to a drain of the first transistor and another end terminal of the first capacitor is connected to a first node, an end terminal of the second capacitor is connected to the first node and another end terminal of the second capacitor is connected to a power supply line, a source of the second transistor is connected to the power supply line, a drain of the second transistor is connected to a second node and a gate of the second transistor is connected to the first node, a source of the third transistor is connected to the first node, a drain of the third transistor is connected to the second node and a gate of the third transistor is connected to a second gate line of the corresponding gate line, a source of the fourth transistor is connected to the second node, a drain of the fourth transistor is connected to an anode of an organic electroluminescence device of the plurality of first pixels, and gate of the fourth transistor is connected to a third gate line of the corresponding gate line, and a cathode of the organic electroluminescence device of each of the plurality of first pixels is connected to ground.

11. The organic electroluminescence display device according to claim 10, wherein;

each of the plurality of second pixels has a third capacitor and a fifth transistor, an end terminal of the third capacitor is connected to the corresponding data line, a source of the fifth transistor is connected to the power supply line, a drain of the fifth transistor is connected to an anode of an organic electroluminescence device of the plurality of second pixels, and a gate of the fifth transistor is connected to another end terminal of the third capacitor, and a cathode of the organic electroluminescence device of each of the plurality of second pixels is connected to ground.

* * * * *